US008740504B2

(12) United States Patent
Oldsen et al.

(10) Patent No.: US 8,740,504 B2
(45) Date of Patent: Jun. 3, 2014

(54) APPARATUS AND METHOD FOR RE-TENSIONING A LOOSE ROOF PLATE IN AN UNDERGROUND MINE

(71) Applicant: FCI Holdings Delaware, Inc., Wilmington, DE (US)

(72) Inventors: John G. Oldsen, Butler, PA (US); John C. Stankus, Canonsburg, PA (US); Travis Mikel Sub, Butler, PA (US)

(73) Assignee: FCI Holdings Delaware, Inc., Wilmington, DE (US)

( * ) Notice: Subject to any disclaimer, the term of this patent is extended or adjusted under 35 U.S.C. 154(b) by 53 days.

(21) Appl. No.: 13/707,681

(22) Filed: Dec. 7, 2012

(65) Prior Publication Data

US 2013/0149046 A1 Jun. 13, 2013

Related U.S. Application Data

(60) Provisional application No. 61/568,369, filed on Dec. 8, 2011.

(51) Int. Cl.
*E21D 21/00* (2006.01)

(52) U.S. Cl.
USPC ..... 405/302.2; 403/365

(58) Field of Classification Search
USPC ..... 405/302.1, 302.2; 403/365
See application file for complete search history.

(56) References Cited

U.S. PATENT DOCUMENTS

| | | | | |
|---|---|---|---|---|
| 5,525,013 | A * | 6/1996 | Seegmiller et al. | 405/259.3 |
| 5,531,545 | A * | 7/1996 | Seegmiller et al. | 405/259.4 |
| 5,733,069 | A | 3/1998 | Schofield, Jr. | |
| 6,637,980 | B2 | 10/2003 | Robertson, Jr. | |
| 7,625,155 | B1 * | 12/2009 | McKinney et al. | 405/302.2 |
| 8,033,760 | B2 * | 10/2011 | Hinton et al. | 405/302.2 |
| 2009/0067932 | A1 | 3/2009 | Fox | |

* cited by examiner

*Primary Examiner* — Tara M. Pinnock
(74) *Attorney, Agent, or Firm* — The Webb Law Firm

(57) ABSTRACT

An apparatus for retensioning a loose roof plate held by a roof bolt, includes a main spacer, a washer, and a nut. The main spacer occupies a space between a head of the roof bolt and the loose roof plate, and the main spacer has a threaded circumferential outer surface and a radially extending slot for inserting a shaft of the roof bolt therein. The washer occupies a space between the main spacer and the loose roof plate, and the washer has a radially extending slot for inserting the shaft of the roof bolt therein. The nut has a threaded hole for passing the head of the roof bolt therethrough, for threading onto the threaded spacer and for tightening onto the threaded spacer until the roof plate is firmly pressed against the roof.

16 Claims, 5 Drawing Sheets

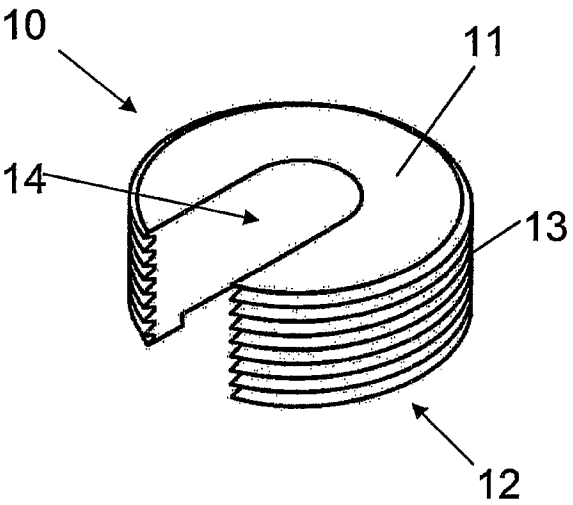
FIG. 2
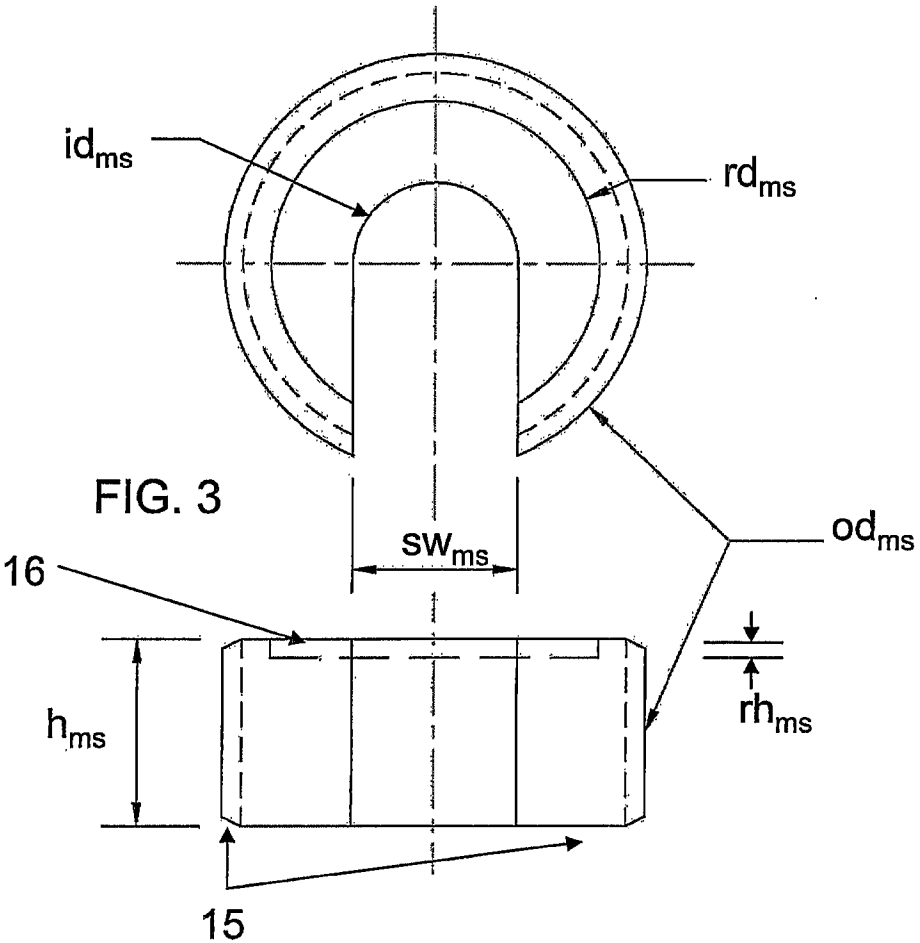
FIG. 3
FIG. 4

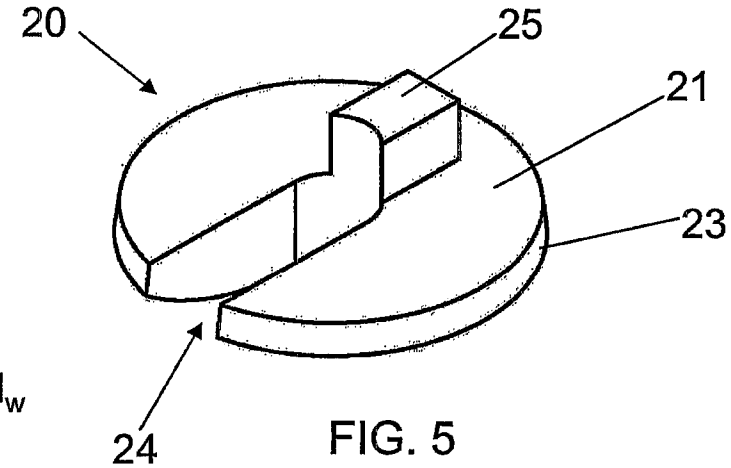
FIG. 5
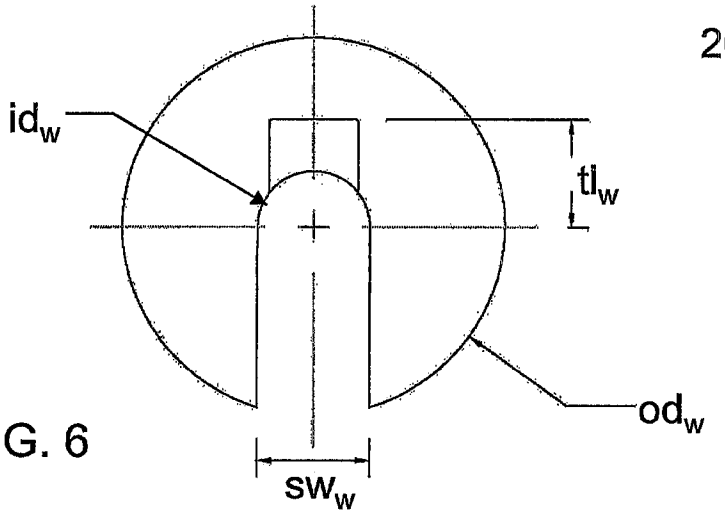
FIG. 6
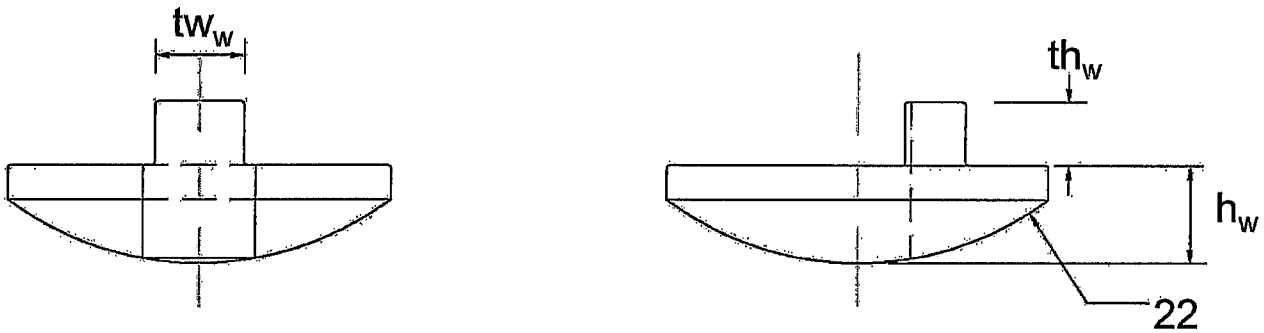
FIG. 8
FIG. 7

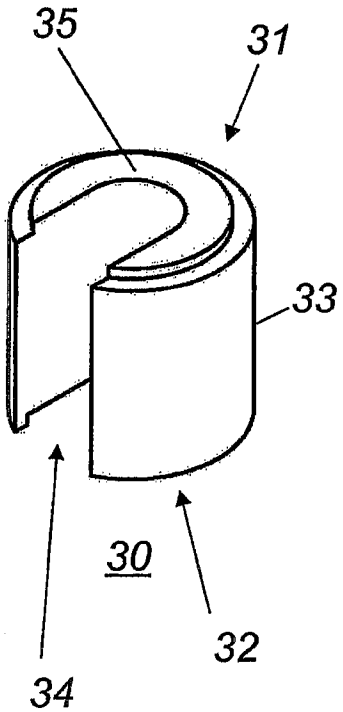
FIG. 9
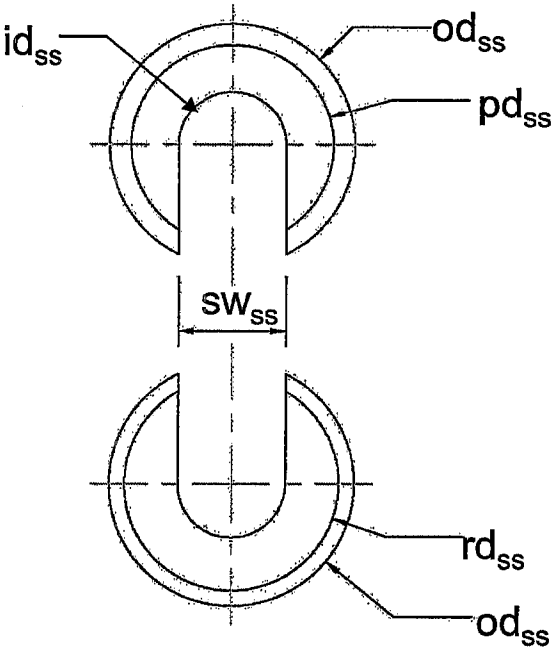
FIG. 10
FIG. 11
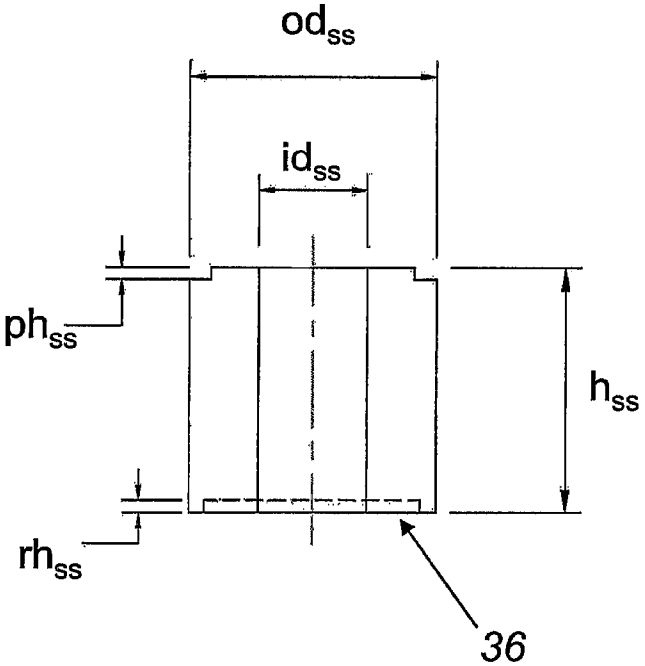
FIG. 12

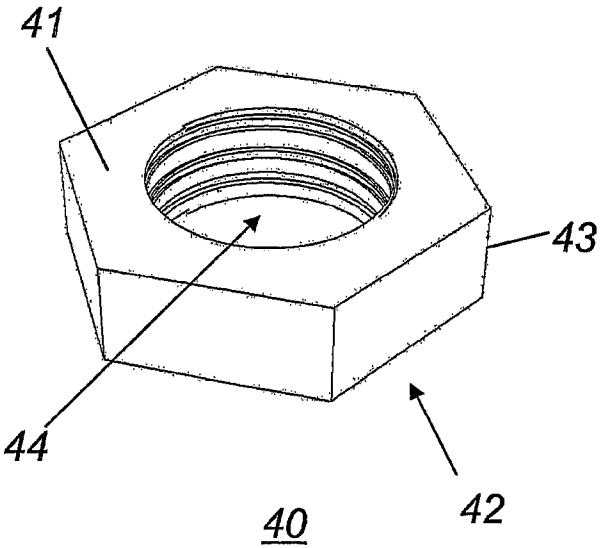
FIG. 13
FIG. 14
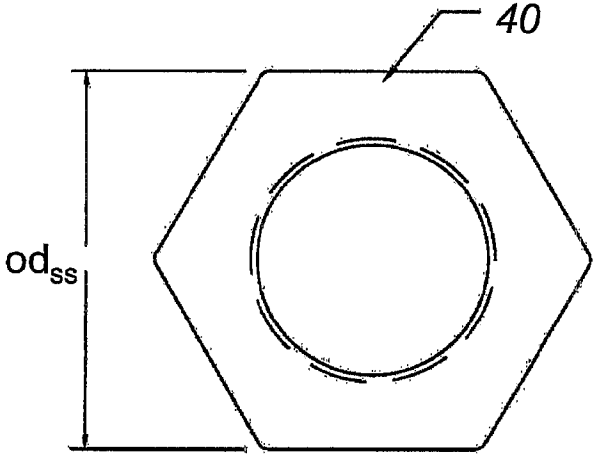
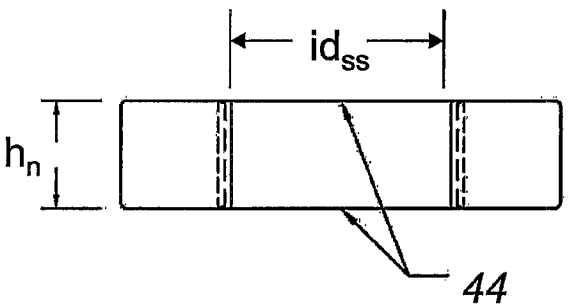
FIG. 15

APPARATUS AND METHOD FOR RE-TENSIONING A LOOSE ROOF PLATE IN AN UNDERGROUND MINE

CROSS REFERENCE TO RELATED APPLICATIONS

This application claims priority from U.S. Provisional Patent Application No. 61/568,369, filed Dec. 8, 2011, which is incorporated herein by reference.

BACKGROUND OF THE INVENTION

1. Field of the Invention

The present invention relates to an apparatus and method for re-tensioning a loose roof plate that has become loose in an underground mine, such as a coal mine.

2. Description of Related Art

Surface mining and deep underground mining are the two basic methods of mining coal. Coal seams relatively close to the surface are usually surface mined, whereas coal seams occurring at greater depths are usually mined underground. Underground mining accounts for most of world's coal production.

In underground mining, roof bolting has been an important technological development for supporting the roof of an underground mine. In roof bolting, bolts are installed within a rock mass to reinforce and stabilize the rock formation above the mine tunnel. Conventionally, it is common practice to drill a hole through a mine tunnel ceiling into the rock formation above. A roof plate is then mounted on to the head of a roof bolt that is installed into the hole. The roof plate is then brought up against the mine ceiling as the roof bolt is tightened into place, allowing the roof plate to applying a pressure against the roof of the tunnel.

Over time, the roof layer just above the roof plate may crumble and flake over time, causing the roof plate to become loose. Support of the roof is compromised because the loose roof plate is no longer applying pressure against the roof of the tunnel. Related art tensioning devices have attempted to solve this problem by reestablishing contact between the roof and the loose roof plate.

U.S. Pat. No. 5,733,069 to Schofield describes an apparatus and method for retensioning a loose roof plate that is held in place by a roof bolt in an underground mine. The device includes an externally threaded split bushing, a spacer unit and an internally threaded nut. To retension the loose roof plate, the externally threaded split bushing is placed around the roof bolt to be in contact with the roof bolt head and between the roof bolt head and the loose roof plate. The spacer unit is then slid over the roof bolt head and over the externally threaded split bushing to be placed into contact with the loose roof plate. The internally threaded nut is then slid over the roof bolt head and threaded onto the externally threaded split bushing until the roof plate is snug against the roof. However, one problem of the Schofield device is the difficulty of threading the internally threaded nut onto the externally threaded split bushing. Another problem is the difficulty of manufacturing.

U.S. Pat. No. 6,637,980 to Robertson describes an apparatus and method for re-tensioning a loose roof plate that is held in place by a roof bolt in an underground mine. The apparatus includes a slotted screw member, a slotted nut and optionally one or more slotted spacers. To re-tension the loose roof plate, the slotted screw member and slotted nut are coupled together, placed around the roof bolt between a head of the roof bolt and the loose roof plate with the head portion of the screw member oriented toward the roof bolt head. Then, the slotted screw member and slotted nut are turned away from each other such as to bias the roof plate against the mine roof. If a gap between the roof bolt head and the roof plate is great, then one or more slotted spacers are placed between the roof bolt head and the head portion of the screw member. However, one problem of the Robertson design is that it cannot be used when the gap between the roof bolt head and the roof plate is less than the length of the slotted screw member. Another problem is the difficulty of manufacturing.

SUMMARY OF THE INVENTION

The apparatus of the present invention includes a main spacer for occupying a space between a head of the roof bolt and the loose roof plate, a washer for occupying a space between the main spacer and the loose roof plate, and a nut. The main spacer may have a threaded circumferential outer surface and a radially extending slot for inserting a shaft of the roof bolt therein. The washer may have a radially extending slot for inserting the shaft of the roof bolt therein. The nut may have a threaded hole for passing the head of the roof bolt therethrough, for threading onto the threaded spacer and for tightening onto the threaded spacer until the roof plate is firmly pressed against the roof. Rotation of the main spacer relative to the washer may be limited by a tab extending from one of the main spacer and the washer into a recess in the other of the main spacer and the washer.

The tab may extend from the washer into the slot of the main spacer. The tab may protrude from a bottom end of the washer a distance less than a height of the main spacer.

The apparatus may further include an additional main spacer having a threaded circumferential outer surface and a radially extending slot for inserting the shaft of the roof bolt therein, and each main spacer may have a different height. The tab may protrude from the bottom end of the washer a distance less than a height of the shortest main spacer.

The nut may include a plurality of flat outer surfaces forming a periphery around the threaded hole of the nut.

The washer may have a domed-shaped top surface.

An outer diameter of the washer may be greater than an outer diameter of the main spacer.

The apparatus may further include one or more supplemental spacers for occupying a space between the main spacer and the roof bolt head. The one or more supplemental spacers each may have a radially extending slot for inserting the shaft of the roof bolt therein. The one or more supplemental spacers may have an outer diameter that is less than an inner diameter of the nut.

A method for retensioning a loose roof plate held by a roof bolt to a roof of the present invention includes placing a main spacer having a threaded circumferential outer surface between a head of the roof bolt and the loose roof plate by inserting a shaft of the roof bolt into a radially extending slot of the main spacer; placing a nut between the main spacer and the head of the roof bolt by passing the head of the roof bolt through a threaded hole of the nut; threading the nut onto the main spacer while rotation of the main spacer is limited; and tightening the nut until the roof plate is firmly pressed against the roof.

The method may further include selecting one main spacer from a plurality of main spacers having different heights depending on the amount of space between the loose roof plate and the head of the roof bolt.

The method may further include placing a washer adjacent to the roof plate by inserting a shaft of the roof bolt into a radially extending slot of the washer, and wherein a tab of the washer extends into the slot of the main spacer to limit rotation of the main spacer relative to the washer.

The method may further include placing one or more supplemental spacers between the main spacer and the head of the roof bolt. The one or more supplemental spacers may be placed between the main spacer and the head of the roof bolt by inserting a shaft of the roof bolt into a radially extending slot of the supplemental spacers. The one or more supplemental spacers may be placed between the main spacer and the head of the roof bolt before the nut is placed between the main spacer and the head of the roof bolt, and the supplemental spacers may be passed through the threaded hole of the nut after the head of the roof bolt is passed through the threaded hole.

BRIEF DESCRIPTION OF THE DRAWINGS

FIG. 2 is a perspective view of a top of the main spacer illustrated in FIG. 1;

FIG. 3 is a top view of the main spacer illustrated in FIG. 2;

FIG. 4 is a front view of the main spacer illustrated in FIG. 2;

FIG. 5 is a perspective view of a bottom of the washer illustrated in FIG. 1;

FIG. 6 is a bottom view of the washer illustrated in FIG. 5;

FIG. 7 is a front view of the washer illustrated in FIG. 5;

FIG. 8 is a side view of the washer illustrated in FIG. 5;

FIG. 9 is a perspective view of the supplemental spacer illustrated in FIG. 1;

FIG. 10 is a top view of the supplemental spacer illustrated in FIG. 9;

FIG. 11 is a bottom view of the supplemental spacer illustrated in FIG. 9;

FIG. 12 is a side view of the supplemental spacer illustrated in FIG. 9;

FIG. 13 is a perspective view of the nut illustrated in FIG. 1;

FIG. 14 is a top view of the nut illustrated in FIG. 13; and

FIG. 15 is a front view of the nut illustrated in FIG. 13.

DETAILED DESCRIPTION OF THE INVENTION

Figure 1:
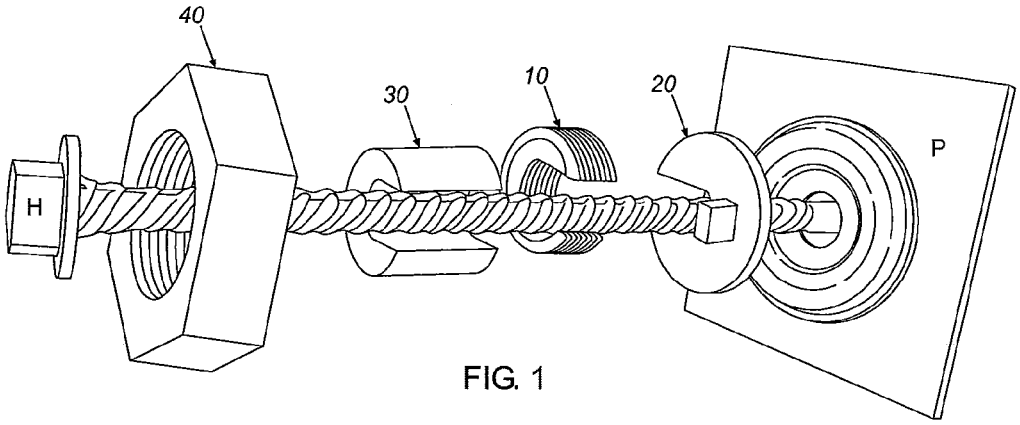
FIG. 1 is a perspective view of an apparatus for retensioning a roof bolt according to an embodiment of the invention.

Although the retensioning apparatus is described below in the context of retensioning a loose roof plate held by a stationary roof bolt, it will be understood that the retensioning apparatus may be used in others circumstances, such as where it is desirable to apply a tension force between a structure having a small-sized shaft-like portion and a large-size head-like portion and an opposing surface.

FIG. 1 shows an exemplary embodiment of a retensioning apparatus 1 that includes a main spacer 10, a washer 20, a supplemental spacer 30 and a nut 40. FIGS. 2-15 illustrate multiple views of the main spacer 10, the washer 20, the supplemental spacer 30 and the nut 40 in greater detail. FIG. 1 also shows a loose roof plate P held by a stationary roof bolt B having a head H and shaft S.

As illustrated in FIGS. 2-4, the main spacer 10 includes an upper surface 11, a lower surface 12, a circumferential threaded outer surface 13 between the upper surface 11 and the lower surface 12, and a slot 14 extending radially into the circumferential threaded outer surface 13. As shown in FIG. 1, the main spacer 10 can be positioned to occupy a space between the loose roof plate P and the roof bolt head H such that the shaft S is inserted into the slot 14 and the main spacer 10 substantially surrounds the shaft S.

As illustrated in FIGS. 5-8, the washer 20 includes an upper surface 21, a lower surface 22, a side surface 23, and a slot 24 extending radially into the side surface 23. The washer 20 further includes a tab 25 extending from the lower surface 22. As shown in FIG. 1, the washer 20 can be positioned to occupy a space between the loose roof plate P and the main spacer 10 such that the shaft S is inserted into the slot 24 and the washer 20 substantially surrounds the shaft S. Meanwhile, the washer 20 can be positioned adjacent to the main spacer 10 such that the tab 25 extends into the slot 14 of the main spacer 10, thereby limiting rotation of the main spacer 10 relative to the washer 20.

As illustrated in FIGS. 9-12, the supplemental spacer 30 includes an upper surface 31, a lower surface 32, a side surface 33, and a slot 34 extending radially into the side surface 33. As shown in FIG. 1, the supplemental spacer 30 can be positioned to occupy a space between the roof bolt head H and the main spacer 10 such that the shaft S is inserted into the slot 34 and the supplemental spacer 30 substantially surrounds the shaft S.

As illustrated in FIGS. 13-15, the nut 40 includes an upper surface 41, a lower surface 42, a side surface 43 and a threaded hole 44 extending from the upper surface 41 to the bottom surface 42. The inner diameter of the threaded hole 44 is large enough to pass the roof bolt head H therethrough, and preferably the inner diameter $id_n$ of the threaded hole 44 is larger than the outer diameter $od_{ss}$ of the supplemental spacer 30, so that both the supplemental spacer 30 and the roof bolt head H can pass through the threaded hole 44 of the nut 40. The threading of the threaded hole 44 corresponds with the threading of the circumferential threaded outer surface 13 of the main spacer 10, so that the nut 44 threads onto the main spacer 10 after the roof bolt head H and supplemental spacer 30 are passed through the threaded hole 44. To facilitate threading the nut 40 onto the main spacer 10, the main spacer 10 may include beveled edges 15 to guide the nut 40 onto the main spacer. Alternatively or additionally, the nut could include beveled edges.

The nut 44, which preferably has a plurality of opposing parallel faces forming the side surface 43, is then tightened onto the main spacer 10 towards the washer 20, while tab 25 that extends into slot 14 limits rotation of the main spacer 10, until the upper surface 41 of the nut 44 passes the upper surface 11 of the main spacer 10 and contacts the lower surface 22 of the washer 20. As the nut 44 is tightened further, and assuming that most of the gap between the roof bolt head H and the loose roof plate P is occupied by the main spacer 10, washer 20 and supplemental spacer 30, then the further tightening of the nut 44 applies an upward force on the washer 20 and a downward force on the main spacer 10, thereby re-applying the tension force between the roof bolt head H and the loose roof plate P.

It will be understood that the above described retensioning apparatus is one exemplary embodiment and that the retensioning apparatus may include variations from the above description as well as additional features, some of which are described below.

In one aspect, the retensioning apparatus may be adaptable to fit various-sized gaps between the loose roof plate P and the roof bolt head H. For example, the supplemental spacer 30 may be omitted for small gaps, or multiple supplemental spacers 30 may be used for larger gaps. Also, the retensioning apparatus may include a plurality of supplemental spacers 30 of varying heights $h_{ss}$, and a supplemental spacer 30 may be selected based on the size of the gap. Similarly, the retensioning apparatus may include a plurality of main spacers 10 of varying heights $h_{ms}$, and the main spacer 10 may be selected based on the size of the gap. Accordingly, the retensioning apparatus may include a kit of components, including a plurality of main spacers 10 having different heights, a plurality of supplemental spacers 30 having different heights, or combinations thereof. In a preferred embodiment, the retensioning apparatus includes a kit including a washer 20 having a height $h_w$ of 0.77 in., first and second main spacers 10 having a heights $h_{ms}$ of 0.50 and 1.00 in., and first, second and third supplemental spacers having heights $h_{ss}$ of 0.50, 1.00 and 2.00 in. In this case, the washer 20 and first main spacer 10 can be employed for gaps as low as about 1.27 in., and the washer 20, second main spacer 10 and first, second and third supplemental spacers can be used for gaps as high as about 5.27 in.

It is also possible to omit the washer 20 and instead use any another means for limiting rotation of the main spacer 10, in order to use the retensioning apparatus for gaps even smaller than about 1.27 in.

Also, it is possible to use both the first and second main spacers 10. In this case, there may be an added inconvenience of threading the nut 40 past both main spacers 10, or it could be possible to positioned one of the main spacers 10 onto the shaft S after the roof bolt head H is passed through the threaded hole 44 of the nut 40.

Similarly, a variety of other types of spacers could be used if the roof bolt head H is passed through the threaded hole 44 of the nut 40 before the spacers are positioned onto the shaft S. In this case, the spacers may be larger than the inner diameter $id_n$ of the threaded hole 44, and/or the slot of the spacers may be omitted.

As mentioned above, it is possible to use the retensioning apparatus without the washer 20. However, including the washer 20 has significant advantages. One advantage is that the washer can limit rotation of the main spacer 10 relative to the washer 20. This is accomplished in the embodiment shown in FIGS. 1-15 and described above by the tab 25 on the lower surface 22 of the washer 20 that extends into the slot 14 of the main spacer 10. Alternatively, the tab 25 on the lower surface 23 of the washer 20 could extend into a recess in the upper surface 11 of the main spacer 10, where the recess is different from the slot 14. In yet another alternative, the lower surface 22 of the washer 20 could include a recess, and the upper surface 11 of the main spacer 10 could include a tab for extending into the recess, in order to limit rotation of the main spacer 10 relative to the washer 20. The embodiment shown in FIGS. 1-15 is preferred for simplicity of manufacture because the slot 14 of the main spacer performs the functions of allowing the shaft S to be inserted therein, as well as serving as a recess into which the tab 25 extends.

In addition to limiting rotation of the main spacer 10 relative to the washer 20, the washer 20 may also prevent shifting of the washer 20 with respect to the roof plate P. As shown in FIGS. 1 and 5-8, the upper surface 21 may be dome-shaped so as to fit within a donut shaped bottom surface of the roof plate P, in order to prevent the shafting with respect to the roof plate P. Alternatively, the upper surface 21 could include another kind of protrusion in order to engage with a corresponding recess of the roof plate P or could include a recess to engage with a corresponding protrusion of the roof plate P, or a combination thereof, in order to prevent shifting of the washer 20 with respect to the roof plate P.

Another feature of the retensioning apparatus is presence of protrusions and recesses on the lower surface 11 of the main spacers and the upper surface 31 and lower surface 32 of the supplemental spacers 30, in order to prevent shifting between these components. As shown in FIGS. 1-4 and 9-12, the lower surface 12 of the main spacer 10 includes a circular recessed portion 16 and the upper surface 31 of the supplemental spacer 30 includes a corresponding circular protruding portion 35. Accordingly, when the lower surface 12 of the main spacer 10 is positioned adjacent to the upper surface 31 of the supplemental spacer 30, the circular recessed portion 16 and circular protruding portion 35 engage with each other to prevent shifting between the main spacer 10 and the supplemental spacer 30. Similarly, FIGS. 1 and 9-12 show that the lower surface 32 of the supplemental spacer 30 includes a circular recessed portion 36. Accordingly, when the upper surface 31 of a first supplemental spacer 30 is positioned adjacent to a lower surface 32 of a second supplemental spacer 30, the circular protruding portion 35 of the first supplemental spacer 30 engages with the circular recessed portion 36 of the second supplemental spacer 30 to prevent shifting between the first and second supplemental spacers 30.

In an alternative embodiment, the placement of the circular recessed portions and circular protruding portions may be reversed, such the lower surface 12 of the main spacer 10 and the lower surface 32 of the supplemental spacer 30 include a circular protruding portion and the upper surface 31 of the supplemental spacer 30 includes a circular recessed portion. However, one advantage of the illustrated embodiment is that that the main spacer 10 having the circular recessed portion 16 has a shorter height when the supplemental spacer 30 is omitted, and therefore the retension apparatus of the illustrated embodiment can be used to retension loose roof plates P when the gap between the loose roof plate P and roof bolt head H is smaller.

In another alternative embodiment, the recessed and protruding portions in the main spacer 10 and supplemental spacer 30 may be non-circular. One advantage of the illustrated circular embodiment over the non-circular alternative embodiment is that circular recessed and protruding portions will engage with each other regardless of the relative orientations of the adjacent spacers, whereas, for example, square recessed and protruding portions would engage only when the adjacent spacers are aligned such that the square recessed and protruding portions match with each other.

In another aspect, the retensioning apparatus may have a number of relationships between the dimensions of the main spacer 10, the washer 20, the supplemental spacer 30 and the nut 40, some of which are described below and others of which can be understood with respect to the figures and an understanding the functioning of the retensioning apparatus.

The inner diameter of the main spacer 10, the washer 20 and the supplemental spacer 30 $id_{ms}$, $id_w$ and $id_{ss}$ are greater than the diameter of the roof bolt shaft S, and less than the diameter of the roof bolt head H. In a preferred embodiment, $id_{ms}$, $id_w$ and $id_{ss}$ are each in the range of 0.50 in to 2.00 in., more preferably 0.75 in to 1.50 in. In an exemplary preferred embodiment, $id_{ms}$, $id_w$ and $id_{ss}$ are each about 0.90 in. Additionally, it is not necessary that the slots include semi-circular shape as shown in the illustrated embodiment. In this case, $id_m$., $id_w$ and $id_{ss}$ may instead indicate the width of the portion of the slots where the roof bolt shaft S is positioned.

The slot widths of the main spacer, the washer and the supplemental spacer $sw_{ms}$, $sw_w$ and $sw_{ss}$ are greater than the diameter of the roof bolt shaft S, and less than the diameter of the roof bolt head H. In a preferred embodiment, $sw_{ms}$, $sw_w$ and $sw_{ss}$ are each in the range of 0.50 in to 2.00 in., more preferably 0.75 in to 1.50 in. In an exemplary preferred embodiment, $sw_{ms}$, $sw_w$ and $sw_{ss}$ are each about 0.90 in.

The width of the tab $tw_w$ is less than the width of the slot of the main spacer $sw_{ms}$, to ensure that the tab fits into the slot. On the other hand the width of the tab $tw_w$ should be large enough to provide enough strength to limit rotation of the main spacer relative to the washer 20. $Tw_w$ is preferably at most ($sw_{ms}$-0.05 in.), more preferably at most ($sw_{ms}$-0.10 in.), and $tw_w$ is at least 0.10 in., more preferably at least 0.50 in. In an exemplary preferred embodiment, $tw_w$ is about 0.70 in.

The height of the tab $th_w$ should be less than the height of the main spacer $h_{ms}$. If the retensioning assembly includes a plurality of main spacers having various heights, the h height of the tab $th_w$ should be less than the height of the shortest main spacer. In an exemplary preferred embodiment, $th_w$ is 0.50 in. or less.

The length of the tab $th_l$ is considered to the distance the tab extends from the center of the washer 20. The length of the tab $th_l$ is less than the inner diameter of the nut $id_n$, to allow the upper surface of the nut to contact the lower surface of the washer, without contacting the tab.

The outer diameter of the main spacer $od_{ms}$ is substantially the same as the inner diameter of the nut $id_n$, to ensure that the nut 40 threads onto the main spacer 10. The outer diameter of the supplemental spacer $od_{ss}$ is preferably less than the inner diameter of the nut $id_n$, to allow the supplemental spacer 30 to pass through the threaded hole 44 of the nut 40.

The outer diameter of the washer $od_w$ should be greater than the inner diameter of the nut $id_n$, so that tightening of the nut 40 presses the upper surface 41 of the nut 40 against the lower surface 22 of the washer 20. Preferably the outer diameter of the washer $od_w$ is at least ($id_n$+0.10 in.) to ensure a sufficient amount of contact between the upper surface of the nut 40 and the lower surface of the washer 20. Additionally, it is not required that the washer 20 has a circular shape. In that case, the $od_w$ is considered to a distance between a center of the washer 20 and a farthest edge of the washer 20.

The diameters of the circular protruding portion of the supplemental spacer $pd_{ss}$ is less than the circular recessed portions of the main spacer $rd_{ms}$ and the supplemental spacer $rd_{ss}$. Preferably $pd_{ss}$ is in range of 0.05 to 0.30 in. less than $rd_{ms}$ and in range of 0.05 to 0.30 in. less than $rd_{ss}$. More preferably, $pd_{ss}$ is about 0.10 in. less than $rd_{ms}$ and $rd_{ss}$. In an exemplary preferred embodiment, $pd_{ss}$ is about 1.65 in. and $rd_{ms}$ and $rd_{ss}$ are about 1.75 in. The heights of the circular protruding portion $ph_{ss}$ and recessed portions $rh_{ms}$, $rh_{ss}$ are preferably about the same as each other and within the range of 0.05 to 0.20 in. In an exemplary preferred embodiment, $ph_{ss}$, $rh_{ms}$, and $rh_{ss}$ are about 0.10 in.

EXAMPLE 1

A specific example of the invention includes first and second main spacers, a washer, first, second and third supplemental spacers and a nut as illustrated in FIGS. 2-15.

The height of the first and second main spacers $h_{ms}$ are 0.50 in. and 1.00 in., respectively. The outer diameter of the main spacers $od_{ms}$ is 2¼ in. with 8 UNC threading. The slot width $sw_{ms}$ and inner diameter $id_{ms}$ of the main spacers is 0.90 in. The diameter of the recessed portion $rd_{ms}$ is 1.75 in. and the height of the recessed portion $rh_{ms}$ is 0.10 in.

The height of the washer $h_w$ is 0.77 in. and the outer diameter of the washer $od_w$ is 3.00 in. The slot width $sw_w$ and inner diameter $id_{ms}$ of the washer is 0.90 in. The height $th_w$, the width $tw_w$ and the length $tl_w$ are 0.50 in., 0.70 in. and 0.85 in., respectively.

The height of the first, second and third supplemental spacers is 0.50 in, 1.00 in. and 2.00 in., respectively. The outer diameter of the supplemental spacers $od_{ss}$ is 2.00 in. The slot width $sw_{ss}$ and inner diameter $id_{ss}$ of the supplemental spacers are 0.90 in. The diameter of the recessed portion $rd_{ss}$ is 1.75 in. and the height of the recessed portion $rh_s$ is 0.10 in. The diameter of the protruding portion $pd_{ss}$ is 1.65 in. and the height of the recessed portion $ph_{ss}$ is 0.10 in.

The height of the nut $h_n$ is 1.00 in. The outer diameter of the nut $od_n$ is 3.50 in., and the inner diameter of the nut $id_n$ is 2¼ in. with 8 UNC threading.

Although the invention has been described in detail for the purpose of illustration based on what is currently considered to be the most practical and preferred embodiments, it is to understood that such detail is solely for that purpose and that the invention is not limited to the disclosed embodiments but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. An apparatus for retensioning a loose roof plate held by a roof bolt, comprising:

a main spacer for occupying a space between a head of the roof bolt and the loose roof plate, the main spacer having a threaded circumferential outer surface and a radially extending slot for inserting a shaft of the roof bolt therein;

a washer for occupying a space between the main spacer and the loose roof plate, the washer having a radially extending slot for inserting the shaft of the roof bolt therein; and a nut having a threaded hole for passing the head of the roof bolt therethrough, for threading onto the threaded spacer and for tightening onto the threaded spacer until the roof plate is firmly pressed against the roof, wherein rotation of the main spacer relative to the washer is limited by a tab extending from one of the main spacer and the washer into a recess in the other of the main spacer and the washer.

2. The apparatus of claim 1, wherein the tab extends from the washer into the slot of the main spacer.

3. The apparatus of claim 2, wherein the tab protrudes from a bottom end of the washer a distance less than a height of the main spacer.

4. The apparatus of claim 3, further comprising an additional main spacer having a threaded circumferential outer surface and a radially extending slot for inserting the shaft of the roof bolt therein, wherein each main spacer has a different height, and wherein the tab protrudes from the bottom end of the washer a distance less than a height of the shortest main spacer.

5. The apparatus of claim 1, wherein the nut includes a plurality of flat outer surfaces forming a periphery around the threaded hole of the nut.

6. The apparatus of claim 1, wherein the washer has a domed-shaped top surface.

7. The apparatus of claim 1, wherein an outer diameter of the washer is greater than an outer diameter of the main spacer.

8. The apparatus of claim 1, further comprising one or more supplemental spacers for occupying a space between the main spacer and the roof bolt head.

9. The apparatus of claim 8, wherein the one or more supplemental spacers each have a radially extending slot for inserting the shaft of the roof bolt therein.

10. The apparatus of claim 9, wherein the one or more supplemental spacers have an outer diameter that is less than an inner diameter of the nut.

11. A method for retensioning a loose roof plate held by a roof bolt to a roof, comprising:

placing a main spacer having a threaded circumferential outer surface between a head of the roof bolt and the loose roof plate by inserting a shaft of the roof bolt into a radially extending slot of the main spacer;

placing a nut between the main spacer and the head of the roof bolt by passing the head of the roof bolt through a threaded hole of the nut;

threading the nut onto the main spacer while rotation of the main spacer is limited; and tightening the nut until the roof plate is firmly pressed against the roof.

12. The method of claim 11, further comprising selecting one main spacer from a plurality of main spacers having different heights depending on the amount of space between the loose roof plate and the head of the roof bolt.

13. The method of claim 11, further comprising placing a washer adjacent to the roof plate by inserting a shaft of the roof bolt into a radially extending slot of the washer, and wherein a tab of the washer extends into the slot of the main spacer to limit rotation of the main spacer relative to the washer.

14. The method of claim 11, further comprising placing one or more supplemental spacers between the main spacer and the head of the roof bolt.

15. The method of claim 14, wherein the one or more supplemental spacers are placed between the main spacer and the head of the roof bolt by inserting a shaft of the roof bolt into a radially extending slot of the supplemental spacers.

16. The method of claim 15, wherein the one or more supplemental spacers are placed between the main spacer and the head of the roof bolt before the nut is placed between the main spacer and the head of the roof bolt, and wherein the supplemental spacers are passed through the threaded hole of the nut after the head of the roof bolt is passed through the threaded hole.

* * * * *